US005282509A

United States Patent [19]

Schurr, III

[11] Patent Number: 5,282,509

[45] Date of Patent: Feb. 1, 1994

[54] METHOD FOR CLEANING CEMENT PLUG FROM WELLBORE LINER

[75] Inventor: Harry W. Schurr, III, Corpus Christi, Tex.

[73] Assignee: Conoco Inc., Ponca City, Okla.

[21] Appl. No.: 933,440

[22] Filed: Aug. 20, 1992

[51] Int. Cl.[5] ..... E21B 29/00

[52] U.S. Cl. ..... 166/311; 166/376

[58] Field of Search ..... 166/311, 376, 170; 175/263, 265, 292, 316

[56] References Cited

U.S. PATENT DOCUMENTS 3,126,065 2/1960 Chadderdon .

3,289,760 2/1964 Kammerer .

5,010,955 4/1991 Springer ..... 166/376 X

*Primary Examiner*—William P. Neuder

*Attorney, Agent, or Firm*—M. Kathryn Braquet Tsirigotis

[57] ABSTRACT

A procedure for drilling out a cement plug from a liner top using a drill bit with extendible cutting elements to avoid the need for changing bits during the procedure.

1 Claim, 3 Drawing Sheets

METHOD FOR CLEANING CEMENT PLUG FROM WELLBORE LINER

BACKGROUND OF THE INVENTION

This invention relates to cementing of liners in wellbores, and more specifically to an improved method of cleaning a cement plug from the top of a liner after it has been cemented in place.

In the drilling of oil and gas wells, it is common to place one or more casing strings in the wellbore extending downward from the surface. These casing strings are typically held in place by cement placed between the borehole wall and the exterior of the casing string(s).

In many cases, a "liner" is run into the uncased portion of a wellbore. A liner is a truncated section of casing that is used to case open hole below a previously set casing string. The liner extends from the bottom of the open hole section and overlaps up into the previously set casing string. The overlap can range from 100 feet to 500 feet. Liners are usually suspended from the previously set casing string by means of a liner hanger/-packer assembly. The liner is cemented in place to create a bond between the pipe and the formation. In cementing the liner, typically the cement is pumped down to the liner and through a running-in tool, followed by a displacement fluid that forces the cement into the annulus between the borehole wall and the liner, and into the overlap between the liner and the previously set casing string, and above the running-in tool. After removing the running-in tool, it is common to end up with a cement "plug" in the lower casing above the top of the liner that has to be drilled out before the well can be placed on production. A further complication is that part of the cement plug, before it sets, settles into the top portion of the liner, and must also be drilled out. Normal cleanout practice is to drill out the cement plug above the liner top with a large diameter bit, and then replace the bit with a smaller one and drill out the plug in the top of the liner. This obviously requires a time consuming "round trip" of the drill pipe in order to change the drill bit.

SUMMARY OF THE INVENTION

In accordance with the present invention, the need for a round trip of the drill pipe is eliminated by using a drill bit having extendible cutting elements that can drill the larger diameter casing plug when the extendible elements are set in the extended position, and that can drill the plug from the liner interior when the extendible elements are set in the retracted position.

The broad concept of a drill bit having remotely extendible cutting elements is not new, and is shown, for example, in U.S. Pat. Nos. 3,126,065 and 3,289,760 to Chadderdon and Kammerer, respectively.

DESCRIPTION OF THE PREFERRED EMBODIMENT

Figure 1:
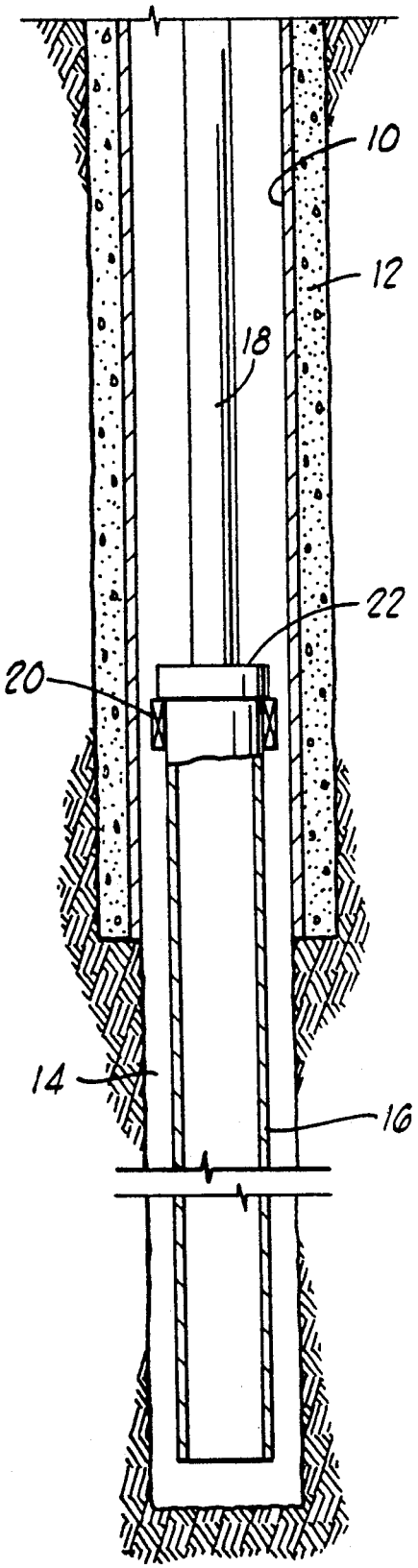
FIGS. 1–6 are a series of views the progression of steps involved in carrying out the process of the invention.

The invention will be described having reference to the several views of the drawings, but it will be understood that certain elements as shown in the drawings are representative of more complex, but presently available, hardware. For example, the liner hangar/packer setting tool and the drill bit with extendible cutting elements are not depicted in detail, and the well as shown indicates only a single casing string, whereas the invention is equally applicable for a well having multiple casing strings.

The essence of this invention lies in the procedure as described below, and not in the particular hardware involved.

The setting for the process of the invention is shown in FIG. 1, which shows a casing 10 surrounded by cement 12 in a wellbore. An open hole portion 14 of the wellbore extends below casing 10, and contains a liner 16 which extends from near the bottom of the open hole portion up into the lower portion of casing 10. Liner 16 is supported by pipe string 18, and a liner hanger/-packer assembly 20 is attached to the upper end of liner 16 to hold the liner in place when the hangar is set. A liner hangar/packer setting tool 22 is shown schematically at the juncture of liner 16 and pipe string 18.

Figure 2:
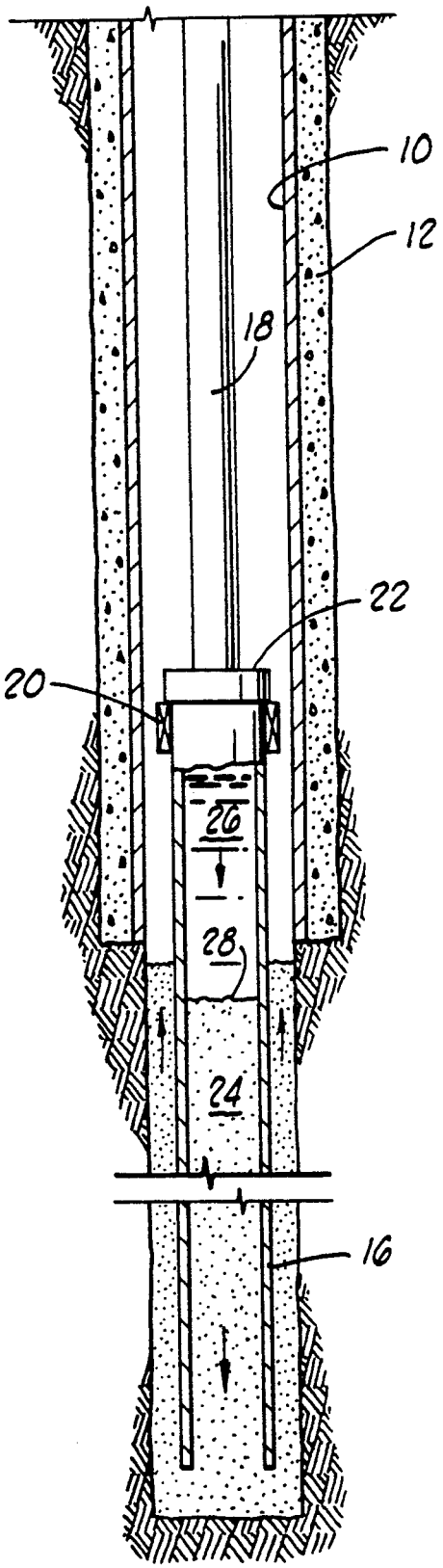
Figure 3:
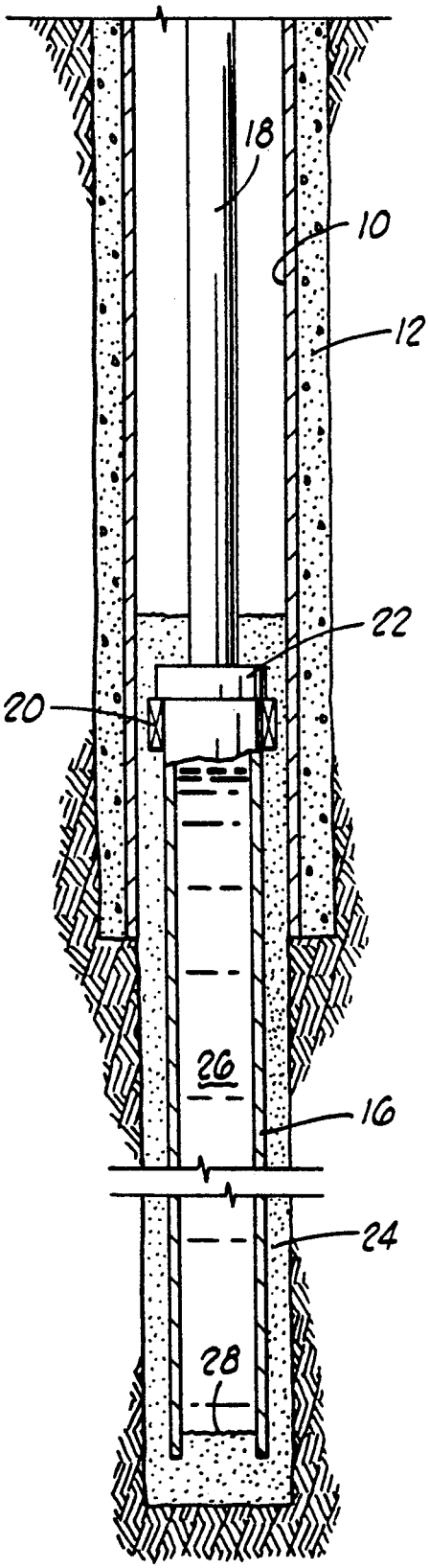
Figure 4:
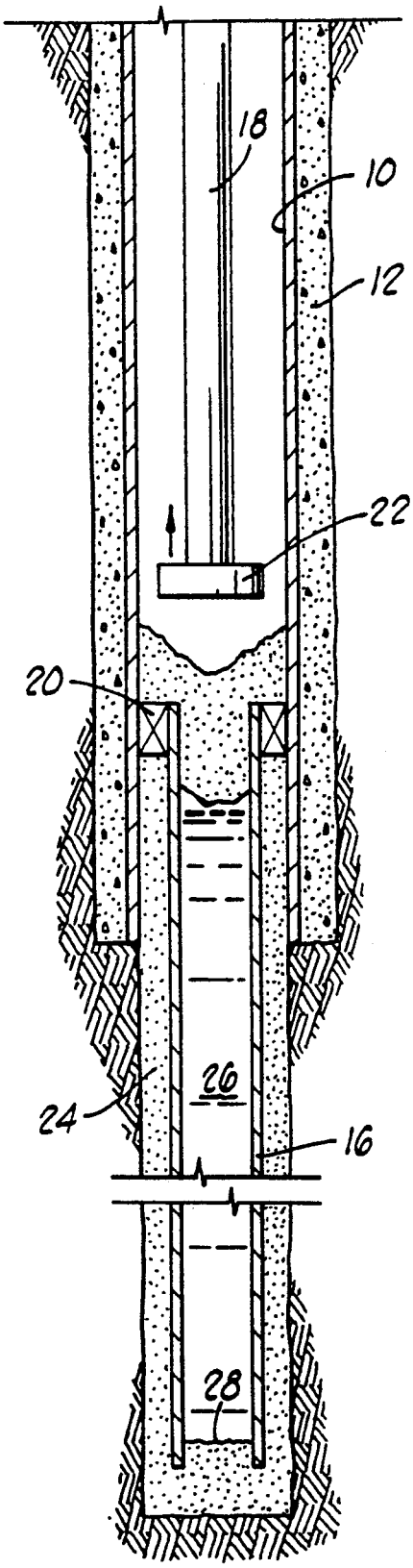

Liner 16 must be secured in place prior to completing and producing the well. This procedure is illustrated in FIGS. 2–4, where a cement slurry shown being pumped down through the liner interior and into the annulus between the open hole section and the liner exterior. A displacement fluid 26 pumped through pipe string 18 provides a cement/fluid interface 28, which in actual practice usually involves use of plug wiper systems (not shown) to provide better control of the cementing operation.

As shown in FIG. 3, pumping of displacement fluid 26 is stopped when cement/fluid interface 28 reaches the bottom of liner 16, at which point a considerable amount of cement slurry extends above the top of liner 16. At this point in the procedure, liner hangar/packer 20 is set via operation of setting tool 22, and setting tool 22 is released from liner 16.

As shown in FIG. 4, pipe string 18 with setting tool 22 is pulled upward out of the still unset cement slurry, a which point some of the slurry above the liner top settles down into the top of liner 16.

Figure 5:
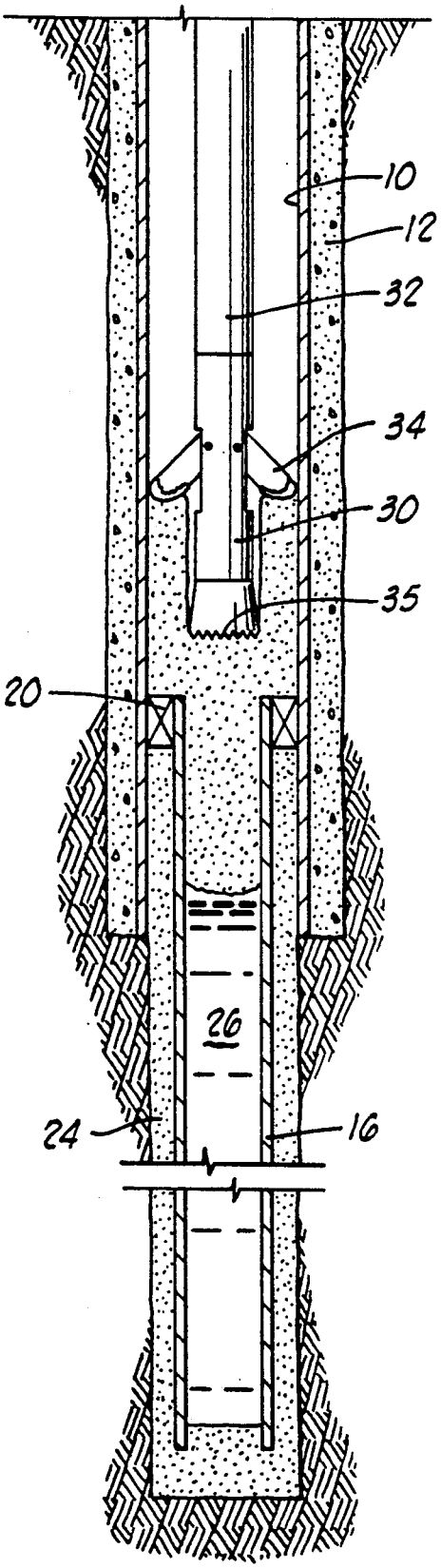

Moving now to FIG. 5, after a suitable waiting period in which the cement slurry sets up, a drill bit 30 including extendible cutting elements 34 above the leading cutting surface 35 is lowered on drill string 32. Extendible cutting elements 34 are initially positioned by fluid pressure, mechanical action or other operating system in the extended position where they contact the outer annulus of cement not removed by the lower part of bit 30. These cutting elements, in addition to cutting the cement, effect a scraping or cleaning action on the interior of casing 10.

Figure 6:
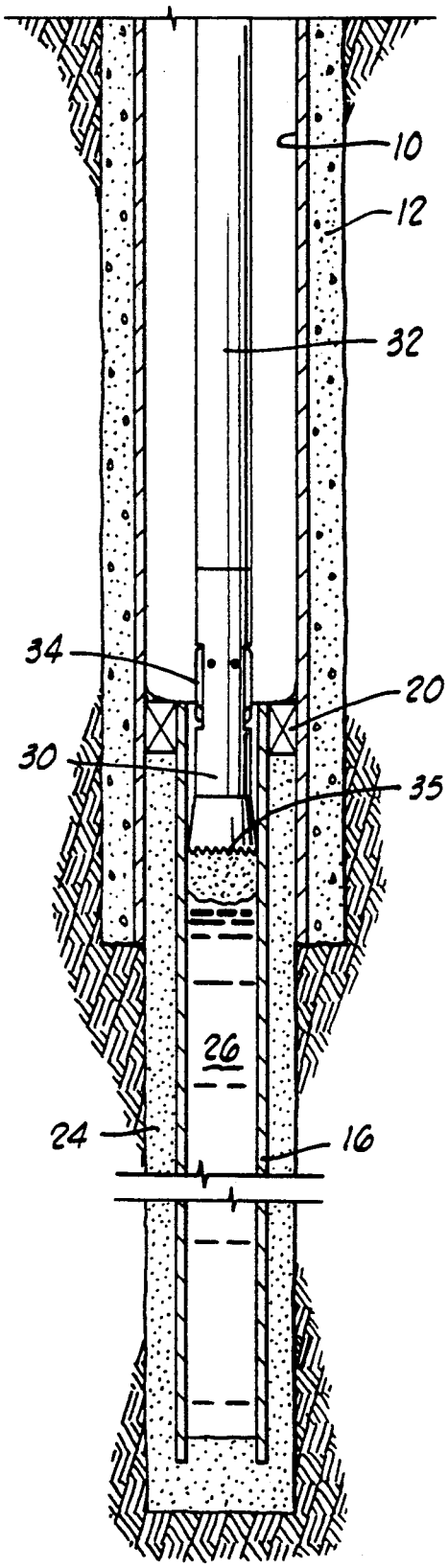

Moving to FIG. 6, after drilling down to the top of liner 16, cutting elements 34 are retracted by remote operation so that the bit can drill down through liner 16 without the need to remove drillstring 32 to change to a smaller diameter bit. Once they are inside liner 16, cutting elements 34 can be extended slightly to clean out any cement remaining on the liner wall after passage of the lower portion of bit 30.

After the cement plug is completely drilled out, bit 30 is retrieved, and normal completion operations can be carried out.

The procedure as described above eliminates the need for "tripping" the drill string to change bits, and results in an improved liner clean out procedure.

I claim:

1. In a method of cementing a liner in a wellbore in which a liner which is run into an open section of a borehole extends back up into the bottom portion of a previously installed casing string, and in which the liner having a liner hangar/packer setting tool releasably attached to the top thereof is cemented in place by pumping a cement slurry down through the liner and into the annulus between the open portion of the wellbore and the outer surface of the liner, and in which said cement slurry extends up into the annulus between the top of said liner and the bottom of said casing string, and in which said cement slurry also extends up into said casing string above the top of said liner and said liner hangar/packer setting tool, and said liner hangar/packer setting tool is detached from said liner top and removed from said cement slurry before it sets, and in which the cement in said casing string above said liner top and any cement which flows into the top portion of said liner is, after setting, drilled out to establish flow communication from the top of said wellbore to the interior of said liner, the improvement comprising:

(a) running a drill bit having extendible cutting elements into said wellbore on a drill string to the top of the set cement in said casing;

(b) drilling set cement from said casing with said extendible cutting elements set in an extended position;

(c) upon reaching the top of said liner, remotely adjusting the cutting diameter of said extendible cutting elements to a retracted setting that will fit through said liner;

(d) drilling out cement from the top portion of said liner; and (e) removing said drill bit from said wellbore.

* * * * *

UNITED STATES PATENT AND TRADEMARK OFFICE

CERTIFICATE OF CORRECTION

PATENT NO. : 5,282,509

DATED : February 1, 1994

INVENTOR(S) : Harry W. Schurr, III

It is certified that error appears in the above-identified patent and that said Letters Patent is hereby corrected as shown below:

Column 1, line 59, after "views" insert --illustrating--.

Column 2, line 23, after "slurry" insert --24 is--.

Signed and Sealed this

Sixteenth Day of August, 1994

Bruce Lehman

*Attest:*

BRUCE LEHMAN

*Attesting Officer*

*Commissioner of Patents and Trademarks*